US010435262B2

(12) United States Patent
Masuda

(10) Patent No.: US 10,435,262 B2
(45) Date of Patent: Oct. 8, 2019

(54) SHEET FEEDING DEVICE AND IMAGE FORMING DEVICE

(71) Applicant: KONICA MINOLTA, INC., Chiyoda-ku, Tokyo (JP)

(72) Inventor: Yoshiyuki Masuda, Kunitachi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/034,444

(22) Filed: Jul. 13, 2018

(65) Prior Publication Data

US 2019/0055098 A1 Feb. 21, 2019

(30) Foreign Application Priority Data

Aug. 18, 2017 (JP) ..... 2017-158125

(51) Int. Cl.

| | |
|---|---|
| ***B65H 7/02*** | (2006.01) |
| ***B65H 9/00*** | (2006.01) |
| ***B65H 3/12*** | (2006.01) |
| ***B65H 7/14*** | (2006.01) |
| ***B65H 7/20*** | (2006.01) |

(52) U.S. Cl.

CPC ..... *B65H 7/02* (2013.01); *B65H 3/128* (2013.01); *B65H 7/14* (2013.01); *B65H 7/20* (2013.01); *B65H 9/00* (2013.01); *B65H 9/006* (2013.01); *B65H 2513/10* (2013.01); *B65H 2513/50* (2013.01); *B65H 2701/1311* (2013.01)

(58) Field of Classification Search

CPC . B65H 3/128; B65H 7/02; B65H 7/14; B65H 7/20; B65H 9/006; B65H 2513/10

See application file for complete search history.

(56) References Cited

U.S. PATENT DOCUMENTS

| | | | | |
|---|---|---|---|---|
| 8,006,976 | B2 * | 8/2011 | Suzuki | B65H 9/008 271/265.01 |
| 8,439,348 | B2 * | 5/2013 | Suzuki | B65H 3/128 271/96 |
| 8,814,163 | B2 * | 8/2014 | Yamagata | B65H 9/006 271/265.01 |
| 9,221,637 | B2 * | 12/2015 | Murata | B65H 3/0669 |
| 9,701,502 | B2 * | 7/2017 | Miyamoto | B65H 9/14 |
| 2019/0071269 | A1 * | 3/2019 | Ikeshita | B65H 3/124 |

FOREIGN PATENT DOCUMENTS

JP 2004-224505 A 8/2004

* cited by examiner

*Primary Examiner* — Jeremy R Severson

(74) *Attorney, Agent, or Firm* — Buchanan Ingersoll & Rooney PC

(57) ABSTRACT

A sheet feeding device includes: a sheet storage that stores a plurality of sheets; a conveyer that conveys, in a sheet conveyance direction, sheets stored inside the sheet storage; a driver that drives the conveyer in such a manner that a conveyance speed of the sheet is switchable between two or more speeds; a corrector that corrects inclination of the sheet more on a downstream side in the sheet conveyance direction than the conveyer is; a first sheet detector that detects a sheet positioned at a first predetermined position between the conveyer and the corrector; and a hardware processor that controls the driver to change a conveyance speed of the sheet conveyed by the conveyer in accordance with a detection result of the first sheet detector.

6 Claims, 6 Drawing Sheets

SHEET FEEDING DEVICE AND IMAGE FORMING DEVICE

The entire disclosure of Japanese patent Application No. 2017-158125, filed on Aug. 18, 2017, is incorporated herein by reference in its entirety.

BACKGROUND

Technological Field

The present invention relates to a sheet feeding device and an image forming device.

Description of the Related Art

In the related art, there is a known sheet feeding device that feeds sheets to an image forming device such as a copying machine or a printer. For example, JP 2004-224505 A discloses an air system sheet feeding device (hereinafter referred to as "air sheet feeding device") that includes a sheet storage, a suction conveyer, a floating air blower, a separation air blower, an outlet port roller, and the like.

In this air sheet feeding device, air is blown by the floating air blower toward a sheet end face of a sheet bundle stored in the sheet storage, thereby floating a sheet from the sheet bundle. The floated sheet is sucked to the suction conveyer, and sent in a conveyance direction by the suction conveyer. Considering that the sent sheet is inclined due to the floating state by the air, the sheet is conveyed while having the inclination corrected at the outlet port roller.

In the suction conveyer, the sheet is conveyed by a predetermined conveyance amount, considering that the inclination of the sheet is corrected at the outlet port roller. Specifically, the sheet is made to abut against the outlet port roller by conveyance of the suction conveyer, and the sheet is sent into the outlet port roller only by a predetermined length such that a predetermined amount of slack is generated between the suction conveyer and the outlet port roller.

However, in a case where a first sheet to be conveyed is not sufficiently separated from a sheet bundle, a second sheet positioned below the first sheet may be conveyed together with the first sheet in a state sticking to the first sheet.

When the second sheet is conveyed together with the first sheet, the second sheet advances from a storage position in the sheet storage by a distance corresponding to an amount conveyed together with the first sheet. In other words, a conveyance distance of the second sheet from a conveyance start position of the second sheet to the outlet port roller becomes shorter than a conveyance distance from the storage position to the outlet port roller.

In a case where the second sheet is conveyed by the suction conveyer in this state, a conveyance amount of the second sheet becomes excessive with respect to the distance from the conveyance start position of the second sheet to the outlet port roller because a sheet conveyance amount by the suction conveyer is required to be a constant amount or more. As a result, a slack amount of the second sheet between the outlet port roller and the suction conveyer becomes larger than a predetermined amount, and furthermore, there is a problem that sheet feeding failure may be caused.

Additionally, in the structure disclosed in JP 2004-224505 A, the second sheet is prevented from being conveyed together by sufficiently separating the first sheet from the second sheet. However, with this structure, it is necessary to secure a sufficient time for separation, and therefore, the structure is not preferable in the viewpoint of improving productivity such as speed improvement. Additionally, in a case where states of sheets in the sheet storage are not uniform, separation between a first sheet and a second sheet may become insufficient and the second sheet may be conveyed together with the first sheet, and furthermore, sheet feeding failure may be caused.

Particularly, in a structure in which the suction conveyer is driven by using a stepping motor, a sheet is conveyed by a certain distance at the time of acceleration and deceleration, and therefore, the above-described problem is likely to occur.

SUMMARY

An object of the present invention is to provide a sheet feeding device and an image forming device capable of preventing occurrence of sheet feeding failure caused by plural sheets being conveyed together at the time of sheet feeding.

To achieve the abovementioned object, according to an aspect of the present invention, a sheet feeding device reflecting one aspect of the present invention comprises: a sheet storage that stores a plurality of sheets; a conveyer that conveys, in a sheet conveyance direction, sheets stored inside the sheet storage; a driver that drives the conveyer in such a manner that a conveyance speed of the sheet is switchable between two or more speeds; a corrector that corrects inclination of the sheet more on a downstream side in the sheet conveyance direction than the conveyer is; a first sheet detector that detects a sheet positioned at a first predetermined position between the conveyer and the corrector; and a hardware processor that controls the driver to change a conveyance speed of the sheet conveyed by the conveyer in accordance with a detection result of the first sheet detector.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
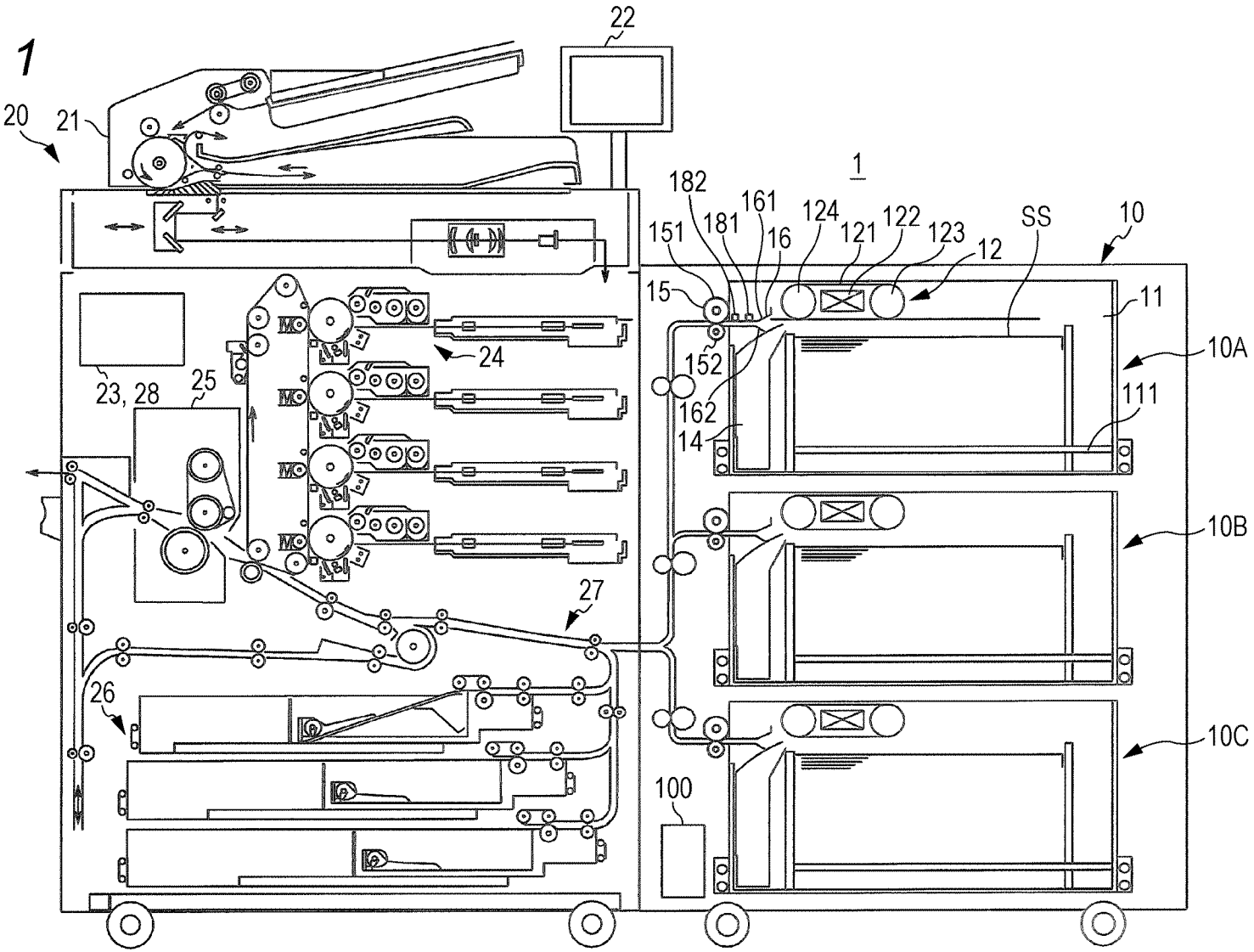
FIG. 1 is a view illustrating an entire structure of an image forming system according to an embodiment of the present invention.

Hereinafter, one or more embodiments of the present invention will be described in detail with reference to the drawings. However, the scope of the invention is not limited to the disclosed embodiments. FIG. 1 is a view illustrating an entire structure of an image forming system 1 according to the present embodiment. As illustrated in FIG. 1, the image forming system 1 has a structure in which an external large capacity sheet feeding device 10 (hereinafter referred to as "sheet feeding device 10") is connected to a side of an image forming device 20 (right side in FIG. 1).

Figure 2:
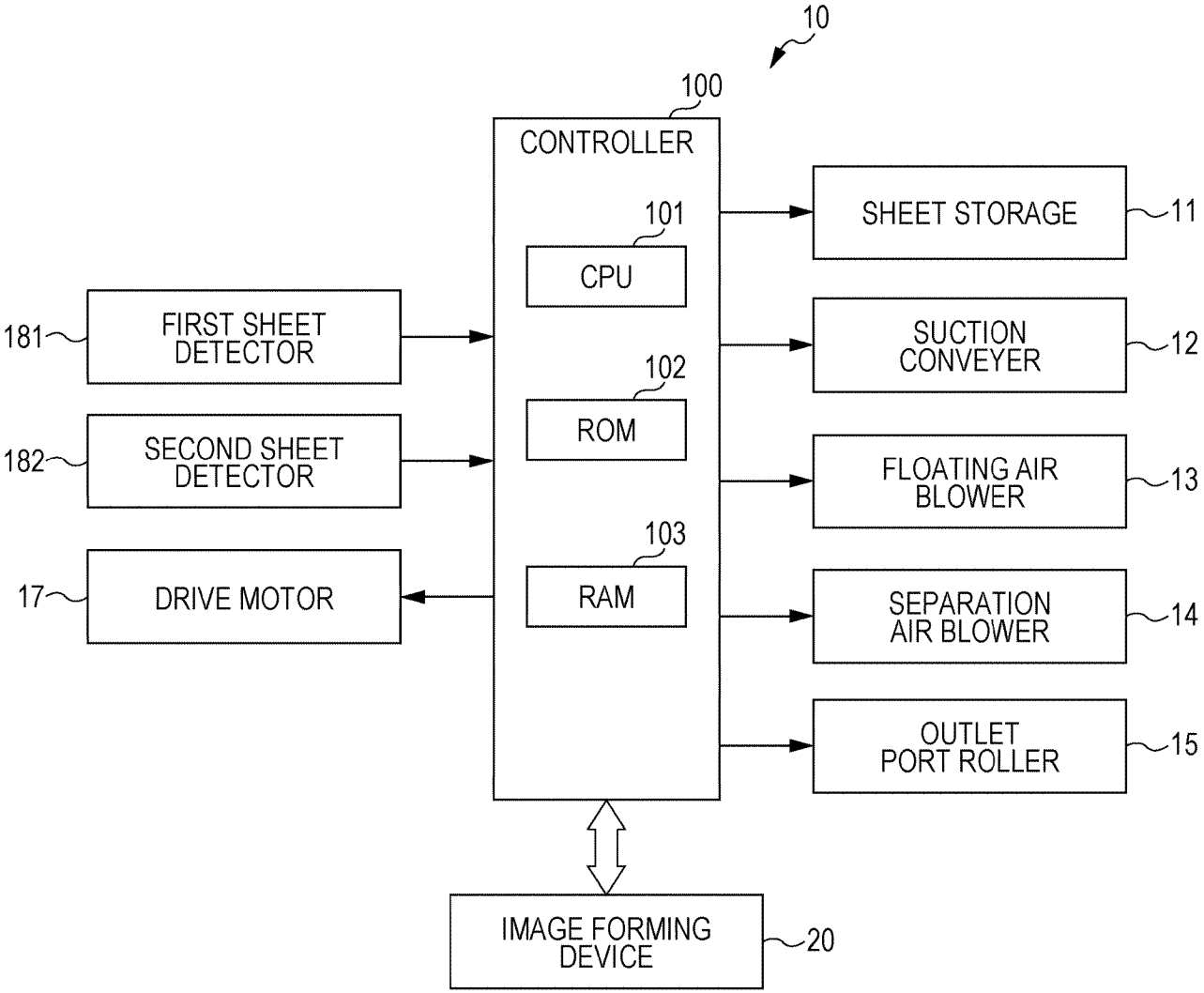
FIG. 2 is a diagram illustrating a main part of a control system of a sheet feeding device according to the present embodiment.

The sheet feeding device 10 includes three sheet feeding units 10A to 10C inside thereof, and feeds sheets one by one to the image forming device 20. As illustrated in FIG. 2, the sheet feeding device 10 includes a controller 100 including a central processing unit (CPU) 101, a read only memory (ROM) 102, a random access memory (RAM) 103, and the like.

The controller 100 cooperates with a controller 28 of the image forming device 20 to perform centralized control for operation of respective blocks in the sheet feeding device 10. Specifically, the controller 100 controls operation of a sheet storage 11, a suction conveyer 12, a separation air blower 14, and an outlet port roller 15 on the basis of a control signal from the image forming device 20 or input signals from a first sheet detector 181 and a second sheet detector 182 described later. The sheet feeding units 10A to 10C will be described in detail later.

The image forming device 20 is a color image forming device of an intermediate transfer system utilizing an electrophotographic process technology. In the image forming device 20, adopted is a vertical tandem system in which photosensitive drums corresponding to four colors of CMYK are arranged in series in a travel direction (vertical direction) of an intermediate transfer belt, and toner images of the respective colors are sequentially transferred onto the intermediate transfer belt by a single procedure. In other words, the image forming device 20 forms an image by: transferring the toner images of the respective colors of Y (yellow), M (magenta), C (cyan) and K (black) formed on the photosensitive drums to the intermediate transfer belt (primary transfer); and superimposing the four color toner images on the intermediate transfer belt; and then transferring the superimposed image on a sheet (secondary transfer).

The image forming device 20 includes an image reader 21, an operation display 22, an image processor 23, an image former 24, a fixing unit 25, a sheet feeder 26, a sheet conveyer 27, and the controller 28.

The controller 28 includes a central processing unit (CPU), a read only memory (ROM), a random access memory (RAM), and the like. The CPU reads a program corresponding to processing content from the ROM, develops the program in the RAM, and controls operation of the respective blocks of the image forming device 20 in cooperation with the developed program. Additionally, the controller 28 cooperates with the controller 100 of the sheet feeding device 10 to control operation of the sheet feeding device 10.

The image reader 21 includes an auto document feeder (ADF), a document image scanning device (scanner), and the like. In the image reader 21, a document conveyed from the auto document feeder onto a contact glass or a document placed on the contact glass is read by the document image scanning device, and input image data is generated.

The operation display 22 is formed of, for example, a liquid crystal display (LCD) with a touch panel, and functions as a display and an operation member.

The image processor 23 applies, to input image data, initial setting or various kinds of correction processing such as gradation correction, color correction, and shading correction, and digital image processing such as compression processing. The image former 24 is controlled on the basis of the image data subjected to the above processing.

The image former 24 forms images of the respective color toners of Y component, M component, C component, and K component on the basis of the image data. Each image former 24 includes a photosensitive drum, a charging device, an exposure device, a developing device, and an intermediate transfer device.

In the image former 24, a surface of the photosensitive drum is uniformly charged by the charging device. The exposure device irradiates the charged photosensitive drum with laser light based on the image data, thereby forming an electrostatic latent image on the surface of the photosensitive drum. Then, toner is supplied by the developing device to the photosensitive drum on which the electrostatic latent image is formed, thereby visualizing the electrostatic latent image and forming a toner image. This toner image is transferred to a sheet by the intermediate transfer device including the intermediate transfer belt and the like.

The fixing unit 25 includes: an upper fixing unit including a fixing surface side member arranged on a side of a fixing surface of a sheet (surface on which the toner image is formed); and a lower fixing unit including a back surface side support member arranged on a side of a back surface of the sheet (surface opposite to the fixing surface). The back surface side support member is pressed against the fixing surface side member, thereby forming a fixing nip that nips and convey a sheet. The fixing unit 25 fixes a toner image on a sheet at the fixing nip by heating and pressing the conveyed sheet on which a toner image has been secondarily transferred.

The sheet feeder 26 includes a plurality of sheet feeding trays (three trays in FIG. 1). Sheets of preset sheet types (standard sheet, special sheet) are stored in the respective sheet feeding trays in a manner classified on the basis of a basis weight, a size (length and width), and the like.

The sheet conveyer 27 conveys, to the image former 24, a sheet fed from the sheet feeder 26 or the sheet feeding device 10. When the sheet passes a secondary transfer unit of the image former 24, toner images on the intermediate transfer belt are collectively secondarily transferred onto one surface (front surface) of the sheet, and fixing processing is applied at the fixing unit 25. The sheet on which the image has been formed is ejected to the outside of the machine by a sheet ejection roller. In a case of forming images on both sides of a sheet, the sheet on which the image has been formed on a front side is conveyed to a conveying path for a back side, and then conveyed to the image former 24 in a reversed state.

The sheet feeding units 10A to 10C will be described. In the following, a "sheet conveyance direction" is a direction from a right side to a left side in FIGS. 1, 3, 5A, 5B, and 6.

As illustrated in FIG. 1, each of the sheet feeding units 10A to 10C includes the sheet storage 11, the suction conveyer 12, a floating air blower 13, the separation air blower 14, the outlet port roller 15, a guide member 16, the first sheet detector 181, the second sheet detector 182, and the like. Each of the sheet feeding units 10A to 10C basically has the same structure. In the following description, the sheet feeding unit 10A will be described as a representative, and description for the sheet feeding units 10B and 10C will be omitted.

The sheet storage 11 can store a large amount of sheets and includes a sheet loading table 111 and the like. The sheet storage 11 can be pulled out from the sheet feeding device 10 by a guide rail (not illustrated).

The sheet loading table 111 can be moved up and down such that an upper end face (uppermost sheet) of a sheet bundle SS loaded thereon is constantly positioned at a fixed position. The sheet loading table 111 is moved down to a lowermost position at the time of replenishing sheets. The up-down movement of the sheet loading table 111 is controlled by the controller 100.

A plurality of suction conveyers 12 is arranged above the sheet loading table 111 and provided in parallel in a width direction of the sheet. Each of the plurality of suction conveyers 12 includes an endless conveyance belt 121, an air suction member 122, and the like. The suction conveyer 12 corresponds to a "conveyer" of the present invention. The conveyance belt 121 corresponds to a "belt member" of the present invention.

The conveyance belt 121 has many suction holes over an entire surface thereof, sucks a sheet with the suction holes, and conveys the sheet in the sheet conveyance direction. The conveyance belt 121 is wound around: a roller 123 provided more on an upstream side in the sheet conveyance direction than the air suction member 122 is; and a roller 124 provided more on a downstream side in the sheet conveyance direction than the air suction member 122 is. A sheet conveyance surface by the conveyance belt 121 is a horizontal surface.

The plurality of rollers 123 is provided corresponding to the plurality of conveyance belts 121 and attached to a common roller shaft. The roller shaft is connected to a drive motor 17 (refer to FIG. 2) via a power transmission mechanism (not illustrated). When the controller 100 drives the drive motor 17, the plurality of rollers 123 is rotated and the plurality of conveyance belts 121 travels in a certain direction.

The plurality of rollers 124 is provided corresponding to the plurality of conveyance belts 121 and attached to a common roller shaft. Each of the rollers 124 is rotated by following travel of each of the conveyance belts 121.

The air suction member 122 passes through the plurality of conveyance belts 121 and extends to an inner side of the device, and includes a suction duct (not illustrated) and a suction fan (not illustrated). When the suction fan is actuated, the inside of the suction duct becomes a negative pressure, and a sheet is sucked to the conveyance belt 121 via the suction holes. Operation of the suction fan is controlled by the controller 100.

As illustrated in FIG. 2, the floating air blower 13 includes a blowing fan and an air guide path not illustrated. The floating air blower 13 is arranged, for example, inside a side end regulating member that regulates a side end of the sheet bundle SS in the sheet storage 11. The blower fan can control an air blow rate in accordance with, for example, a sheet length, sheet quality, a basis weight, and the like such that the air can be blown at an appropriate air blow rate. Operation of the blower fan is controlled by the controller 100.

In the floating air blower 13, when the blower fan is actuated, the floating air is blown upward and blown to an upper portion of the sheet bundle SS from both sides in the sheet width direction. As a result, several upper sheets of the sheet bundle SS are floated.

The separation air blower 14 includes a blower fan and an air guide path. The separation air blower 14 is arranged so as to be able to blow air to an end portion more on the downstream side in the sheet conveyance direction than the suction conveyer 12 is. The blower fan 141 can control an air blow rate in accordance with, for example, a sheet size (length, width), sheet quality, a basis weight, and the like such that the air can be blown at an appropriate blow rate. Operation of the blower fan is controlled by the controller 100.

The separation air blower 14 may have a blow direction switching plate (not illustrated), and may switch an air blow direction between the vicinity of a front end of the suction conveyer 12 and the vicinity of a front end of the sheet bundle SS. In this case, the separation air blower 14 blows floating air to the vicinity of the front end of the sheet bundle SS at the time of blowing the floating air by the floating air blower 13, and the separation air blower 14 blows the separation air to the vicinity of the front end of the suction conveyer 12 when the floating air blow by the floating air blower 13 is stopped. In other words, the separation air blower 14 also functions as a floating air blower.

When the blower fan is actuated in the separation air blower 14, air is blown to the vicinity of the front end of the sheet bundle SS or the vicinity of the front end of the suction conveyer 12 via an air blow port of the air guide path. Since the floating air is blown to the vicinity of the front end of the sheet bundle SS, several upper sheets of the sheet bundle SS can be efficiently floated. Additionally, by blowing the separation air to the vicinity of the front end of the suction conveyer 12, second and subsequent sheets can be separated from a plurality of sheets sucked to the conveyance belt 121, and only a first sheet can be sucked to and conveyed by the conveyance belt 121.

The outlet port roller 15 includes an upper conveyance roller 151 (refer to FIG. 1) and a lower conveyance roller 152 (refer to FIG. 1) that abuts on the upper conveyance roller 151. The upper conveyance roller 151 is a driving roller, and the lower conveyance roller 152 is a driven roller. The outlet port roller 15 holds a sheet conveyed by the suction conveyer 12 between the upper conveyance roller 151 and the lower conveyance roller 152 and sends the sheet to the downstream side in the sheet conveyance direction.

As illustrated in FIG. 1, the guide member 16 is arranged more on the upstream side in the sheet conveyance direction than the outlet port roller 15 is, includes an upper guide plate 161 and a lower guide plate 162, and guides the sheet conveyed by the suction conveyer 12 to the outlet port roller 15. The sheet is conveyed through a gap formed by the upper guide plate 161 and the lower guide plate 162.

Figure 3:
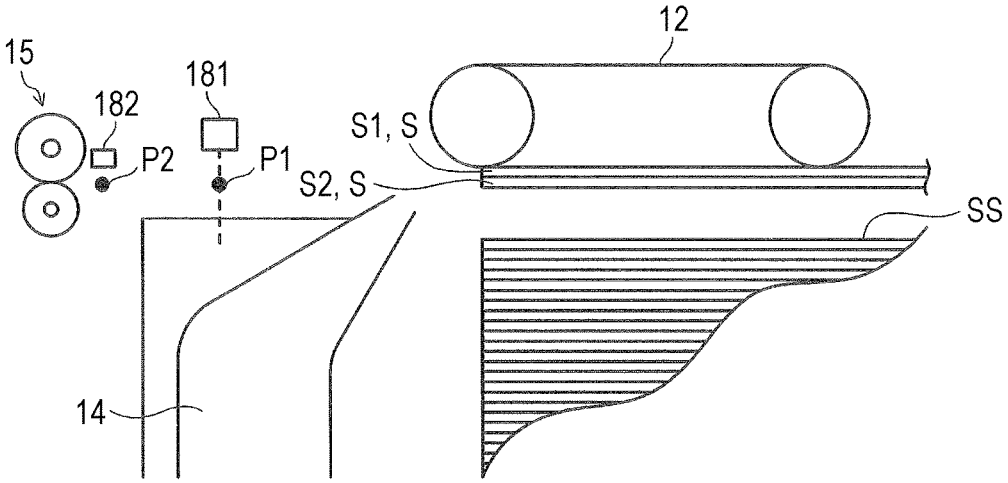
FIG. 3 is an enlarged view of a sheet conveyance path between a suction conveyer and an outlet port roller.

Additionally, as illustrated in FIG. 3, the first sheet detector 181 and the second sheet detector 182 are provided in the sheet conveyance path between the suction conveyer 12 and the outlet port roller 15. The first sheet detector 181 and the second sheet detector 182 are, for example, photosensors or the like, and detect a sheet S sent from the suction conveyer 12.

The first sheet detector 181 detects the sheet S passing a first predetermined position P1 in the sheet conveyance path. The second sheet detector 182 detects the sheet S passing a second predetermined position P2 in the sheet conveyance path. The second predetermined position P2 is a position located more on the downstream side than the first predetermined position P1 is, in other words, a position closer to the outlet port roller 15 than the first predetermined position P1 is, and also is a position before the outlet port roller 15. The controller 100 controls sheet conveyance on the basis of detection results of the first sheet detector 181 and the second sheet detector 182.

Meanwhile, in a case of a sheet feeding system in which a sheet S is floated and fed by floating air, the sheet S sucked by the suction conveyer 12 may be inclined due to the floating state of the sheet S from the sheet storage 11. Considering such inclination of the sheet S, inclination of the sheet S is corrected at the outlet port roller 15. The outlet port roller 15 corresponds to a "corrector" of the present invention.

In the suction conveyer 12, a sheet is conveyed by a predetermined conveyance amount, considering correction of inclination of the sheet at the outlet port roller 15. Specifically, the sheet S is made to abut against the outlet port roller 15 by conveyance of the suction conveyer 12, and sent to the outlet port roller 15 by a predetermined length such that a predetermined amount of slack can be generated between the suction conveyer 12 and the outlet port roller 15.

In other words, the controller 100 controls the suction conveyer 12 and the outlet port roller 15 such that the predetermined amount of slack can be generated on the sheet S between the suction conveyer 12 and the outlet port roller 15 at the time of correcting inclination of the sheet S. For example, the predetermined amount corresponds to substantially a slack amount of the sheet S that does not cause sheet feeding failure at the outlet port roller 15.

In the case of the present embodiment, the suction conveyer 12 is driven by the drive motor 17 (refer to FIG. 2) as an exemplary driver. The drive motor 17 is, for example, a stepping motor, and is set such that a speed of the sheet S becomes a first speed.

Figure 4:
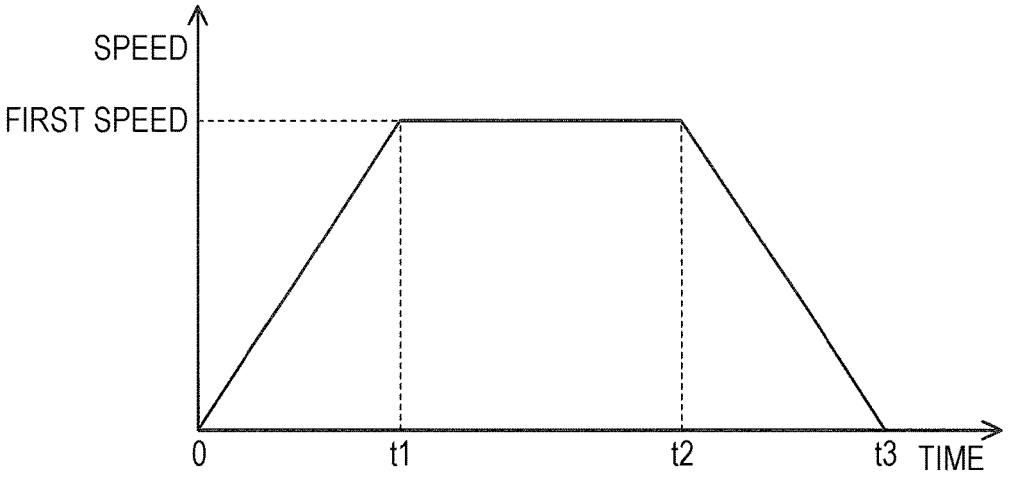
FIG. 4 is a graph illustrating speed fluctuation of a drive motor relative to time.

When the drive motor 17 is set to have the first speed, the drive motor exhibits speed fluctuation as illustrated in FIG. 4. Specifically, the speed of the drive motor 17 is increased with a first slope from a speed 0 state that is a stopped state (period from time 0 to t1 in FIG. 4) and reaches the first speed at time t1.

Then, in a case where the drive motor 17 is stopped at time t2 from the first speed state, the speed of the drive motor 17 is decreased with a second slope (period from time t2 to t3 in FIG. 4), and becomes the speed 0 that is the stopped state at time t3.

A sheet S is thus sent by the suction conveyer 12, but when the sheet S sucked from the sheet bundle SS is not sufficiently separated as illustrated in FIG. 3, a second sheet S2 positioned below a first sheet S1 sticks to the first sheet S1 conveyed by the suction conveyer 12.

Figure 5A:
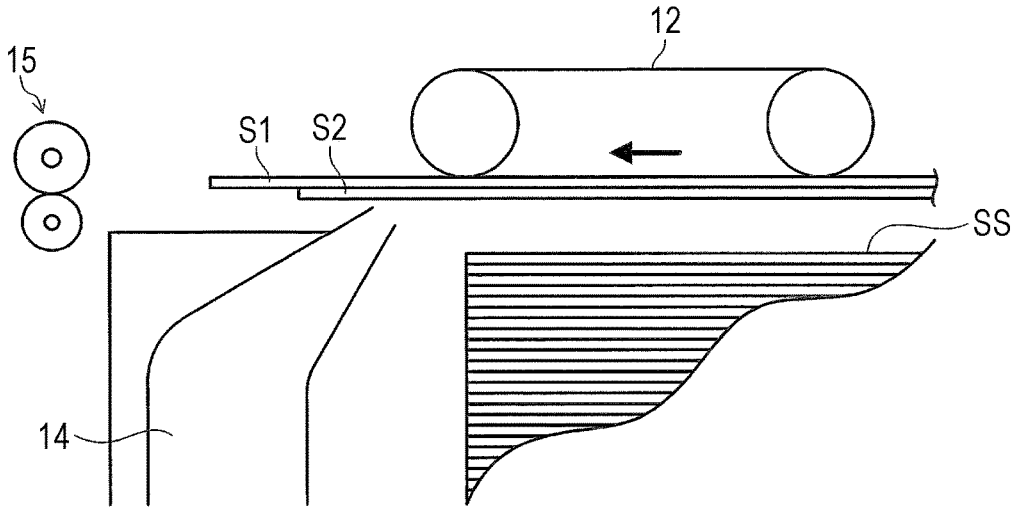
FIG. 5A is a view to describe a state in which plural sheets are conveyed together.
Figure 5B:
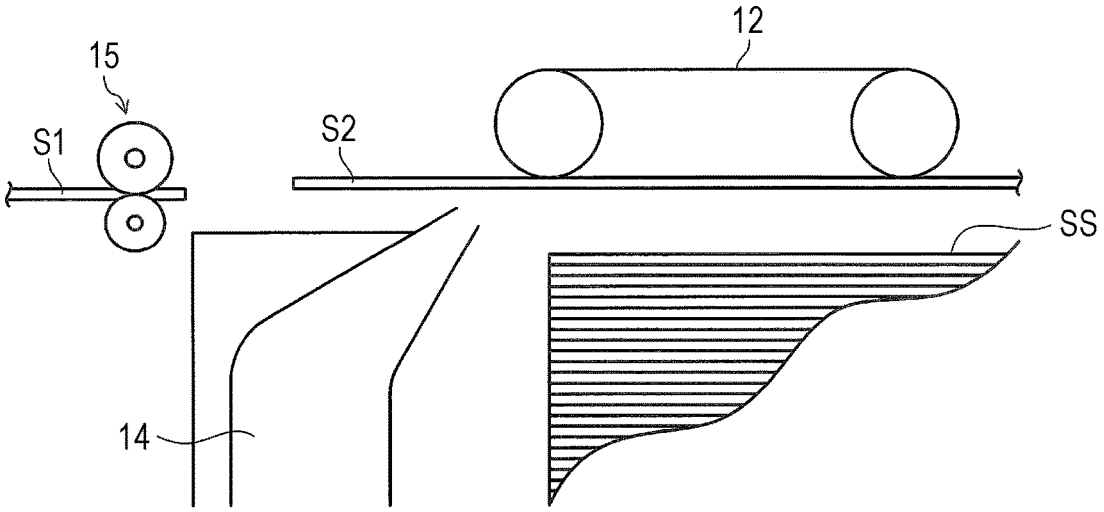
FIG. 5B is a view to describe the state in which plural sheets are conveyed together.

In this case, when the first sheet S1 is conveyed by the suction conveyer 12 as illustrated in FIG. 5A, the second sheet S2 is conveyed together with the first sheet S1. When the second sheet S2 is conveyed together, a part of the second sheet S2 is positioned in the sheet conveyance path even after the first sheet S1 is conveyed by the outlet port roller 15 as illustrated in FIG. 5B.

In other words, since the second sheet S2 advances from a storage position by a distance corresponding to a distance conveyed together with the first sheet S1, a conveyance distance of the second sheet S2 from a conveyance start position of the second sheet S2 to the outlet port roller 15 becomes shorter than a conveyance distance from the storage position to the outlet port roller 15.

In a case of conveying the second sheet S2 in this state, a conveyance amount of the second sheet S2 becomes excessive in the sheet conveyance path with respect to the distance from the conveyance start position of the second sheet S2 to the outlet port roller 15 because a sheet conveyance amount by the suction conveyer 12 is required to be a constant amount or more. As a result, slack of the second sheet S2 in the sheet conveyance path becomes larger than a predetermined amount, and furthermore, a problem of sheet feeding failure is caused.

Figure 6:
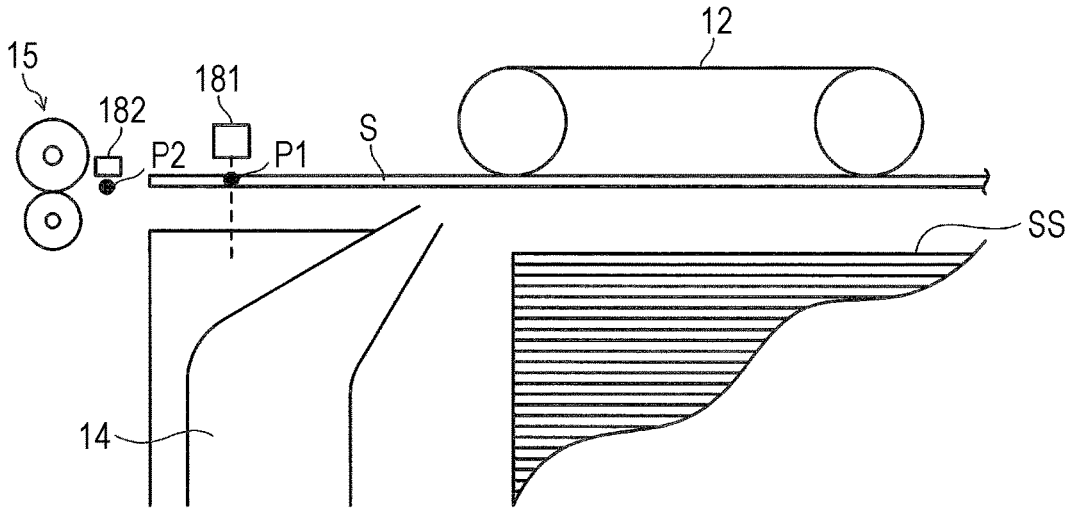
FIG. 6 is an enlarged view of a sheet conveyance path between the suction conveyer and the outlet port roller.

Therefore, in the present embodiment, the controller 100 controls the drive motor 17 to change a conveyance speed of the sheet S in accordance with a detection result of the first sheet detector 181 as illustrated in FIG. 6. Specifically, in a case where the sheet S is not detected by the first sheet detector 181 before the sheet S is conveyed by the suction conveyer 12, the controller 100 controls the drive motor 17 to convey the sheet S at the first speed.

In a case where the sheet S is detected by the first sheet detector 181 before the sheet S is conveyed by the suction conveyer 12, the controller 100 controls the drive motor 17 to convey the sheet S at a second speed slower than the first speed. The second speed is, for example, half the speed of the first speed.

Figure 7:
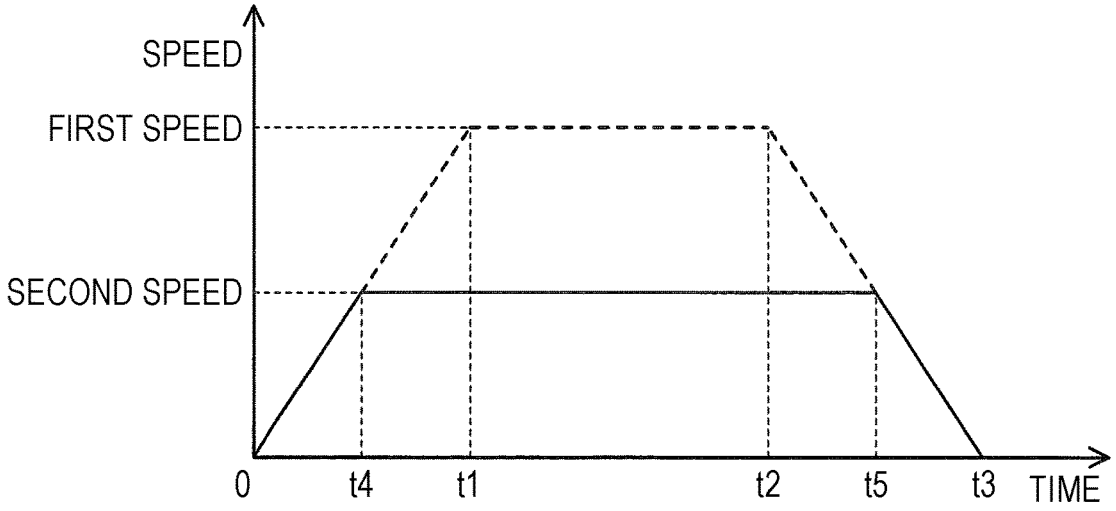
FIG. 7 is a graph illustrating speed fluctuation of the drive motor relative to time.

In a case where the conveyance speed is the second speed, the drive motor 17 exhibits speed fluctuation as illustrated in FIG. 7. Specifically, the speed rises from the stopped state (time 0) with the first slope same as the first speed (time 0 to t4) and reaches the second speed (time t4).

Then, in a case of stopping the drive motor 17 at time t5 from the state of the second speed, the speed of the drive motor 17 falls with the second slope and is decreased (period from time t5 to t3 in FIG. 7), and becomes 0 that is the stopped state at time t3.

Thus, a shortest conveyance amount of the sheet S by the suction conveyer 12 can be changed by changing the conveyance speed of the sheet S by the suction conveyer 12. Specifically, the conveyance amount of the sheet S at the second speed can be made shorter than the conveyance amount of the sheet S at the first speed.

Consequently, even in a case where the second sheet S2 is conveyed together with the first sheet S1 and the distance to the outlet port roller 15 from the conveyance start position of the second sheet S2 before conveyance by the suction conveyer 12 is shortened, the conveyance amount can be adjusted to this shortened distance. Therefore, since the conveyance amount of the sheet S in the sheet conveyance path can be prevented from becoming excessive, the slack of the sheet S at the time of correcting inclination can be appropriately set, and furthermore, occurrence of sheet feeding failure can be prevented.

Additionally, in the present embodiment, the drive motor 17 is a stepping motor. In the case of the stepping motor, it is necessary to have a first period during which the speed rises from the stopped state to a set speed and a second period during which the speed falls from the set speed to the stopped state.

In the case of FIG. 7, in a case where the speed is set to the first speed, a period from time 0 to time t1 becomes the first period, and a period from time t2 to time t3 becomes the second period. In a case where the speed is set to the second speed, a period from time 0 to time t4 becomes the first period, and a period from time t5 to time t3 becomes the second period.

In other words, in a case where the suction conveyer 12 is driven by the drive motor 17, a sheet S is moved by only a minimum moving distance that is a sum of a moving distance of the sheet S during the first period and a moving distance of the sheet S during the second period.

Therefore, even in a case where the conveyance speed is changed, the conveyance amount of the sheet S may become excessive depending on the minimum moving distance at the conveyance speed and the distance from a leading end of the sheet S to the outlet port roller 15 in a position of the sheet S in the sheet conveyance path.

Considering such a situation, in the present embodiment, the second speed is set such that the distance from the second predetermined position P2 to the outlet port roller 15 becomes longer than the sum of a first distance and a second distance. The first distance is a distance that the sheet S is moved from time 0 to time t4 and the second distance is a distance that the sheet S is moved from time t5 to time t3.

The distance from the second predetermined position P2 to the outlet port roller 15 is, for example, a distance from the second predetermined position P2 to the nip of the outlet port roller 15. The first distance is the distance that the sheet S is moved while the conveyance speed of the sheet S reaches the second speed from the stopped state. The second distance is the distance that the sheet S is moved while the conveyance speed of the sheet S is decreased from the second speed to the stopped state. In other words, the sum of the first distance and the second distance is the minimum moving distance of the sheet S at the second speed.

With this configuration, even in a case where the conveyance start position of the sheet S is positioned between the first sheet detector 181 and the second sheet detector 182, a conveyance distance of the sheet S becomes longer than the minimum moving distance of the sheet S at the second speed. As a result, it is possible to prevent the conveyance amount of the sheet S from becoming excessive by adjusting the period during which the speed reaches the second speed (period from time t4 to time t5).

Additionally, the first speed is set such that the distance from the first predetermined position P1 to the outlet port roller 15 becomes longer than the sum of a third distance and a fourth distance. The third distance is a distance that the sheet S is moved from time 0 to time t1, and the fourth distance is a distance that the sheet S is moved from time t2 to time t3.

The distance from the first predetermined position P1 to the outlet port roller 15 is, for example, a distance from the first predetermined position P1 to the nip of the outlet port roller 15. The third distance is the distance that the sheet S is moved while the conveyance speed of the sheet S reaches the first speed from the stopped state. The fourth distance is the distance that the sheet S is moved while the conveyance speed of the sheet S is decreased from the first speed to the stopped state. In other words, the sum of the third distance and the fourth distance is the minimum moving distance of the sheet S at the first speed.

With this configuration, in a case where the sheet S is conveyed at the first speed when the conveyance start position of the sheet S is positioned before the first predetermined position P1, the conveyance distance of the sheet S becomes longer than the minimum moving distance of the sheet S at the first speed. As a result, in the case where the sheet S is not detected by the first sheet detector 181, it is possible to prevent the conveyance amount of the sheet S from becoming excessive by adjusting the period during which the speed reaches the first speed (period from time t1 to time t2).

Meanwhile, the period during which the speed reaches the first speed (period from time t1 to time t2) and the period during which the speed reaches the second speed (period from time t4 to time t5) can be adjusted by controlling timing to stop the drive motor 17 in accordance with a detection result of the second sheet detector 182.

Additionally, the first speed is set such that the distance from the second predetermined position P2 to the outlet port roller 15 becomes shorter than the sum of the third distance and the fourth distance. Consequently, when the conveyance speed is kept at the first speed in a case where the leading end of the sheet S is positioned between the first predetermined position P1 and the second predetermined position P2, the conveyance amount of the sheet S becomes excessive with high possibility. Therefore, in this case, the conveyance amount of the sheet S can be surely prevented from becoming excessive by changing the conveyance speed to the second speed.

Additionally, in the present embodiment, the drive motor 17 is controlled by referring to a table related to the speed fluctuation between the second speed indicated by a solid line and the first speed indicated by a broken line illustrated in FIG. 7. This table is stored in, for example, a storage or the like mounted on the sheet feeding device 10. Note that the conveyance speed by the suction conveyer 12 may also be sequentially calculated without referring to the table.

Figure 8:
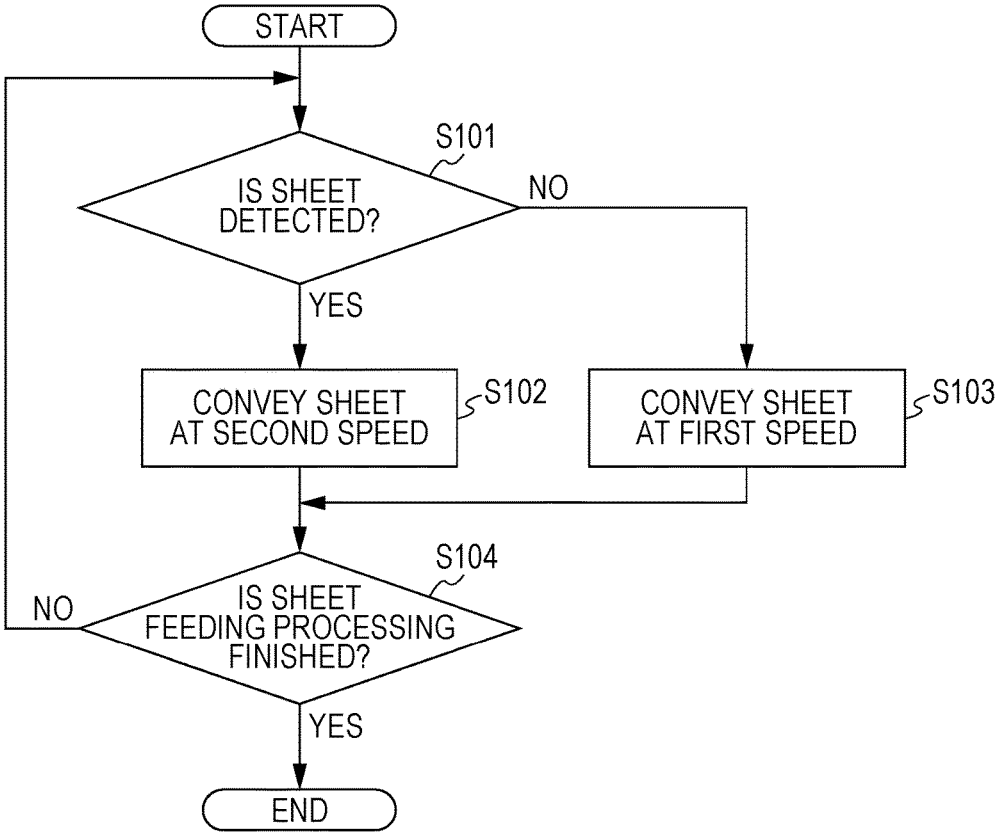
FIG. 8 is a flowchart illustrating exemplary operation at the time of executing conveyance control in the sheet feeding device.

Next, exemplary operation at the time of executing conveyance control in the sheet feeding device 10 will be described. FIG. 8 is a flowchart illustrating exemplary operation at the time of executing conveyance control in the sheet feeding device 10. Processing in FIG. 8 is executed when the controller 100 receives a command to execute sheet feeding processing.

As illustrated in FIG. 8, the controller 100 determines whether the first sheet detector 181 detects a sheet S (step S101). In a case where the first sheet detector 181 detects the sheet S as a result of determination (YES in step S101), the controller 100 performs control to convey the sheet S at the second speed (step S102).

On the other hand, in a case where the first sheet detector 181 does not detect the sheet S (NO in step S101), the controller 100 performs control to convey the sheet S at the first speed (step S103).

After step S102 and step S103, the controller 100 determines whether sheet feeding processing is finished (step S104). In a case where the sheet feeding processing is not finished as a result of determination (NO in step S104) the processing returns to step S101. On the other hand, in a case where the sheet feeding processing is finished (YES in step S104), this control ends.

According to the above-described present embodiment, the conveyance speed of a sheet S is changed on the basis of a detection result of the first sheet detector 181. Specifically, in a case where the sheet S is detected by the first sheet detector 181, the conveyance speed of the sheet S is changed to the second speed that is slower than the first speed. As a result, a conveyance amount of the sheet S in the sheet conveyance path can be prevented from becoming excessive, and therefore, a slack amount of the sheet S can be appropriately set, and furthermore, occurrence of sheet feeding failure can be prevented.

Meanwhile, sheet feeding failure caused by plural sheets S being conveyed together can be prevented by sufficiently securing a time to separate a sheet S in order to prevent separation failure, but such a structure is not preferable in the viewpoint of improving productivity such as speed improvement.

However, in the present embodiment, the conveyance amount of the sheet S can be reduced by decreasing the conveyance speed of the sheet S without changing the conveyance time by the suction conveyer 12 at the outlet port roller 15. Therefore, even in a case where sufficient time cannot be secured to separate a sheet S in order to improve productivity, occurrence of sheet feeding failure caused by the sheets S being conveyed together can be prevented.

Additionally, in a case where states of sheets S in the sheet storage 11 are not uniform, in other words, in a case where adhesion between sheets in a sheet bundle SS is high, the sheets are likely to be not sufficiently separated and the sheets S may be conveyed together with high possibility. However, since the conveyance amount of the sheet S can be reduced in the present embodiment, occurrence of sheet feeding failure caused by the sheets S being conveyed together can be prevented, and robustness against non-uniform states of the sheets can be improved.

Furthermore, since the suction conveyer 12 is driven by using the stepping motor in the present embodiment, a sheet is conveyed by a certain distance at the time of acceleration/deceleration. Specifically, as illustrated in FIG. 7, the sheet S is surely conveyed by the minimum moving distance that is the sum of a moving distance of the sheet S during rising of the drive motor 17 and a moving distance of the sheet S during falling of the drive motor 17. Therefore, when separation failure or the like occurs and the sheets S are conveyed together, there tends to be a problem that the conveyance amount of the sheet S becomes excessive.

However, in the present embodiment, in a case where the sheet S is detected by the first sheet detector 181, the conveyance speed of the sheet S is delayed, and therefore, occurrence of such a problem can be prevented.

Note that, in the above embodiment, the suction conveyer 12 is exemplified as the conveyer, but the present invention is not limited thereto, and a conveyer other than the suction conveyer may also be used.

Additionally, in the above-described embodiment, the drive motor 17, namely, the stepping motor is exemplified as an exemplary driver, but the present invention is not limited thereto, and any member that can switch a conveyance speed of a sheet S between two or more speeds may be used.

Furthermore, in the above-described embodiment, the sheet feeding device 10 is exemplified as a separate body from the image forming device 20, but the present invention is not limited thereto, and a sheet feeding device may be mounted inside an image forming device.

Although embodiments of the present invention have been described and illustrated in detail, the disclosed embodiments are made for purposes of illustration and example only and not limitation. The scope of the present invention should be interpreted by terms of the appended claims. In other words, the present invention can be implemented by various forms without departing from the spirit or essential characteristics thereof.

What is claimed is:

1. A sheet feeding device comprising:

a sheet storage that stores a plurality of sheets;

a conveyer that conveys, in a sheet conveyance direction, sheets stored inside the sheet storage;

a driver that drives the conveyer in such a manner that a conveyance speed of the sheet is switchable between two or more speeds;

a corrector that corrects inclination of the sheet more on a downstream side in the sheet conveyance direction than the conveyer is;

a first sheet detector that detects a sheet positioned at a first predetermined position between the conveyer and the corrector; and a hardware processor that controls the driver to change a conveyance speed of the sheet conveyed by the conveyer in accordance with a detection result of the first sheet detector, wherein in a case where the sheet is not detected by the first sheet detector before the sheet is conveyed by the conveyer, the hardware processor controls the driver to convey the sheet at a first speed, and in a case where the sheet is detected by the first sheet detector before the sheet is conveyed by the conveyer, the hardware processor controls the driver to convey the sheet at a second speed slower than the first speed.

2. The sheet feeding device according to claim 1, further comprising a second sheet detector that detects a sheet positioned at a second predetermined position closer to the corrector than the first predetermined position is, wherein a distance from the second predetermined position to the corrector is longer than a sum of a first distance and a second distance, the first distance is a distance that the sheet is moved while the conveyance speed of the sheet reaches the second speed from a stopped state, and the second distance is a distance that the sheet is moved while the conveyance speed of the sheet is decreased from the second speed to the stopped state.

3. The sheet feeding device according to claim 1, wherein a distance from the first predetermined position to the corrector is longer than a sum of a third distance and a fourth distance, the third distance is a distance that the sheet is moved while the conveyance speed of the sheet reaches the first speed from the stopped state, and the fourth distance is a distance that the sheet is moved while the conveyance speed of the sheet is decreased from the first speed to the stopped state.

4. The sheet feeding device according to claim 1, wherein the conveyer includes a belt member positioned above a sheet stored in the sheet storage, and sucks and conveys the sheet in the sheet conveyance direction.

5. The sheet feeding device according to claim 1, wherein the driver is a stepping motor.

6. An image forming device comprising the sheet feeding device according to claim 1.

* * * * *